US006751978B1

(12) United States Patent
Gagne et al.

(10) Patent No.: US 6,751,978 B1
(45) Date of Patent: Jun. 22, 2004

(54) TRANSITION FITTING

(75) Inventors: Kelly Gagne, St. Charles, IL (US); Jay Griswold, St. Charles, IL (US); Philip Hawken, Darien, IL (US); Robert Moses, Aurora, IL (US)

(73) Assignee: Ranco Incorporated, Wilmington, DE (US)

( * ) Notice: Subject to any disclaimer, the term of this patent is extended or adjusted under 35 U.S.C. 154(b) by 0 days.

(21) Appl. No.: 10/079,514

(22) Filed: Feb. 22, 2002

(51) Int. Cl.[7] ..... B67D 5/62; F16L 39/00; F16L 49/00; F16L 43/00

(52) U.S. Cl. ..... 62/389; 285/124.4; 285/125.1; 285/179

(58) Field of Search ..... 285/179, 124.4, 285/125.1; 62/389; 261/21

(56) References Cited

U.S. PATENT DOCUMENTS 2,911,235 A * 11/1959 Stumbough ..... 285/93
4,034,571 A * 7/1977 Bollinger ..... 62/244
4,261,356 A * 4/1981 Turner et al. ..... 604/246
4,697,613 A * 10/1987 Wienck ..... 137/171
4,783,099 A * 11/1988 Muser ..... 285/7
5,009,552 A * 4/1991 Talcott ..... 406/193
5,388,865 A * 2/1995 Hawkins ..... 285/89
6,152,325 A * 11/2000 Edwards ..... 222/1
6,418,742 B1 * 7/2002 Chaney ..... 62/237

FOREIGN PATENT DOCUMENTS

GB 285279 A2 * 3/1988 ..... F16L/43/00

* cited by examiner

*Primary Examiner*—William C. Doerrler
*Assistant Examiner*—Filip Zec
(74) *Attorney, Agent, or Firm*—Leydig, Voit & Mayer, Ltd.

(57) ABSTRACT

A transition fitting for directing fluid from a first line into a second line includes a body, an inlet, an outlet, and a channel. The body defines a constant-volume channel that redirects a direction of the fluid entering the inlet. The inlet is connected to the body and connectable to the first line, and the inlet directs the fluid from the first line into the channel. The outlet is connected to the body and connectable to the second line, and the outlet directs the fluid from the channel into the second line. The bracket is connected to the body and at least partially surrounds the body.

21 Claims, 7 Drawing Sheets

TRANSITION FITTING

FIELD OF THE INVENTION

The present invention relates to a plumbing fixture and more particularly to a fitting for use in a water supply system of a refrigerator.

BACKGROUND OF THE INVENTION

As a result of an increased awareness of contaminants in the water supply, many people are turning to alternative sources for their water. For example, the bottled drinking water industry has grown significantly in the last 10–20 years. Another alternative method of obtaining clean water has been through the use of household water filtration systems. At one extreme, some water filtration systems have been designed and installed to provide central water filtration for an entire household. However, if a central water filtration system is not being used, the ability to ensure filtered drinking water at each possible source requires that each outlet or faucet have its own filtration system.

Until recently, one potential outlet for drinking water that was not being filtered was the typical household refrigerator. As illustrated in FIG. 1, the refrigerator 110 includes a fluid or water supply system 100 that supplies water to water dispensing devices in the refrigerator 110, such as an automated ice maker 118 and a door water dispenser 122. The water supply system 100 receives the water from a water supply line 114, and the supply of the water is controlled via a valve 112 connected to the water supply line 114. Upon actuation of the valve 112, the valve 112 allows water to flow into supply line 116 for the ice maker 118 and a supply line 120 for the door water dispenser 122. As the refrigerator 110 provides no easy access for an addition of a filtration system, the water being supplied to the ice maker 118 and the door water dispenser 122 is not usually filtered.

The failure of previous refrigerators 110 to provide filtered water was remedied by a redesign that added a filtration system 124 into the water supply system 100, as illustrated in FIG. 2. The addition of the filtration system 124, however, required the water supply system 100 to include additional components. One component that was added was an outlet line 130 from the filtration system 124 to the first valve 112.

Another additional component required by the addition of the filtration system 124 is a second valve 126, which connects the water supply line 114 to the inlet line 128 for the filtration system 124. The second valve 126 is required because the water supply line 114 and the inlet line 128 cannot be directly connected. The inlet line 128 is typically a plastic line without any connectors, and the water supply line 114 is typically a copper pipe with a threaded connector. As such, the second valve 126 is necessary to connect the water supply line 114 to the inlet line 128.

The use of a valve to connect a water supply line to an inlet line of a filtration system is, however, problematic. For example, the valve must be energized or activated before water can flow through the valve. As such, the valve is an expensive piece of hardware that also has the potential to fail during use. Another problem with the valve is that the components within a refrigerator are very tightly packed, and available volume for additional components within the refrigerator is very limited. Not only does the valve require considerable volume, the valve is typically oriented such that water flows into and out of the valve along the same direction. This orientation is not ideal in the close quarters of the refrigerator, as the water supply line and/or the inlet line for the filtration system must be bent to accommodate the valve. Thus, there is a present need for an inexpensive and reliable fitting that can easily connect the water supply line to the inlet line.

SUMMARY OF THE INVENTION

These and other needs are met by embodiments of the present invention which provide a transition fitting for directing fluid from a first line into a second line. The transition fitting includes a body, an inlet, an outlet, and a channel. The body defines a constant-volume channel that redirects a direction of the fluid entering the inlet. The inlet is connected to the body and connectable to the first line, and the inlet directs the fluid from the first line into the channel. The outlet is connected to the body and is connectable to the second line, and the outlet directs the fluid from the channel into the second line. The bracket is connected to the body and at least partially surrounds the body. The body is also rotatable relative to the bracket.

When used in a refrigerator having a filtration system, the transition fitting advantageously allows for an easy connection between a water supply line and an inlet line for the filtration system. Also, by having the transition fitting change the direction of water flow received from the water supply such that the water flows in a direction towards the filtration system, bending of the water supply line or the inlet line is not required. The transition fitting can also be attached to a valve in the refrigerator to reduce the amount of space taken up by the transition fitting within the refrigerator.

In aspects of the invention, the inlet and the outlet include a threaded compression connector or a quick-connect connector. Also, the bracket includes two opposing locking tab slots, and the body includes two opposing locking tabs. When the locking tabs are inserted into the locking tab slots, rotation of the body relative to the bracket is prevented in at least one rotational direction. The bracket also includes crimping tabs while the body includes crimping tab slots. When the crimping tabs are inserted into the crimping tab slots, rotation of the body relative to the bracket is also prevented in at least one rotation direction.

In further aspects of the invention, the outlet is detachable from the body. Also, the inlet is detachable from the body and rotatable relative to the body. The bracket includes a top portion, a left side portion, a right side portion, and a rear portion. The left side portion and the right side portion are connected to the rear portion and the top portion, and the top portion includes an inlet hole through which the inlet is partially inserted. The inlet also has a non-circular, bilaterally symmetrical cross-section. Thus, when the inlet is partially inserted into the inlet hole, the top portion of the bracket prevents rotation of the inlet relative to the bracket in at least one rotational direction.

In other aspects of the invention, the transition fitting includes a pair of fasteners. The fasteners are partially inserted into holes in the left side and the right side portions of the bracket. Each of the fasteners is then respectively connected to the body to prevent rotation of the body relative to the bracket in at least one rotational direction. A flow washer can be disposed between the outlet and the body.

In another embodiment of the invention, a refrigerator receiving water from a water supply line is provided. The refrigerator includes at least one water dispensing device, a valve, a filter, and a transition fitting. The valve is connected to and supplies water to at least one water dispensing device. The filter filters the water and supplies the water to the valve.

The transition fitting is connected to the water supply line and supplies the water to the filter. The transition fitting also provides an always-open flow of the water from the water supply line, through the transition fitting, and into an inlet line for the filter.

Additional advantages of the present invention will become readily apparent to those skilled in this art from the following detailed description, wherein only the preferred embodiment of the present invention is shown and described, simply by way of illustration of the best mode contemplated for carrying out the present invention. As will be realized, the present invention is capable of other and different embodiments, and its several details are capable of modifications in various obvious respects, all without departing from the invention. Accordingly, the drawings and description are to be regarded as illustrative in nature, and not as restrictive.

BRIEF DESCRIPTION OF THE DRAWINGS

Reference is made to the attached drawings, wherein elements having the same reference numeral designations represent like elements throughout, and wherein.

DETAILED DESCRIPTION OF EMBODIMENTS OF THE INVENTION

Figure 1:
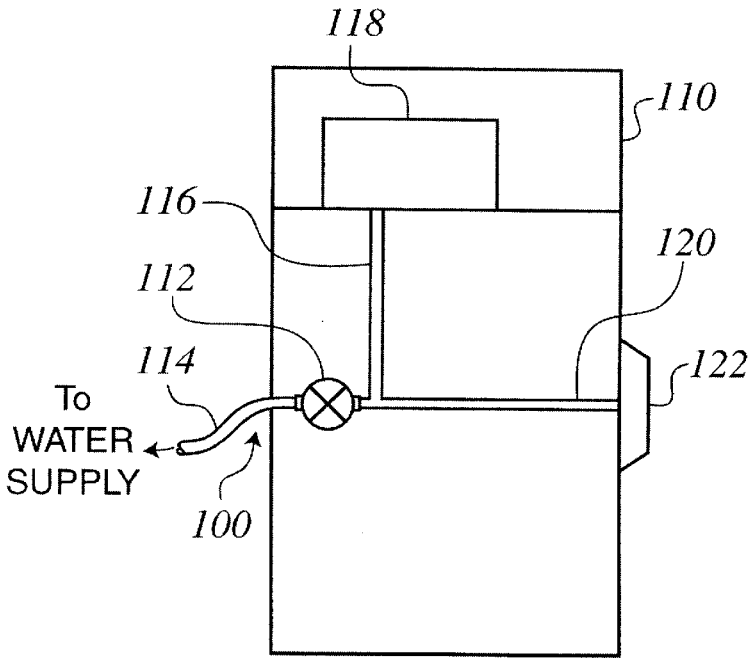
FIG. 1 PRIOR ART
FIG. 1 is a schematic view of a water delivery system in a refrigerator in accordance with the prior art.
Figure 2:
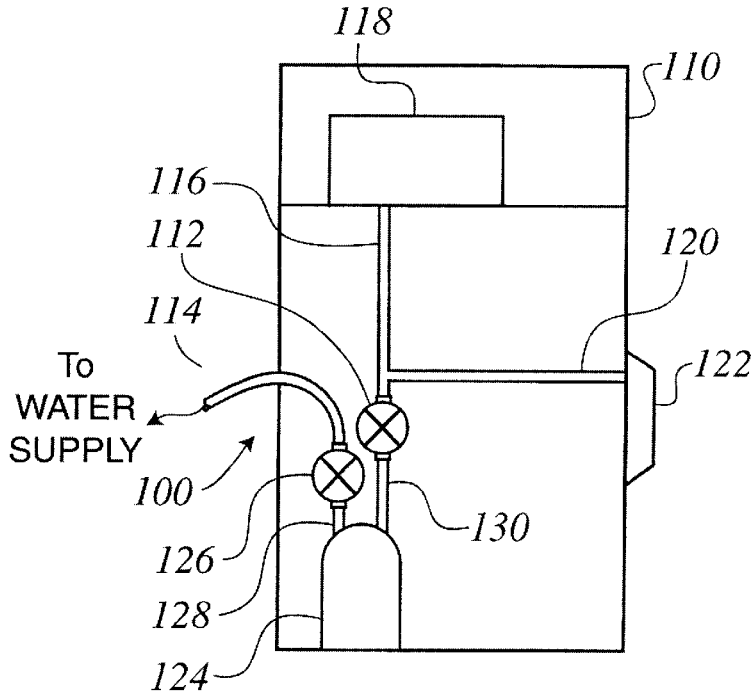
FIG. 2 PRIOR ART
FIG. 2 is a schematic view of the refrigerator of FIG. 1 with a filtration system added to the water delivery system.
Figure 3:
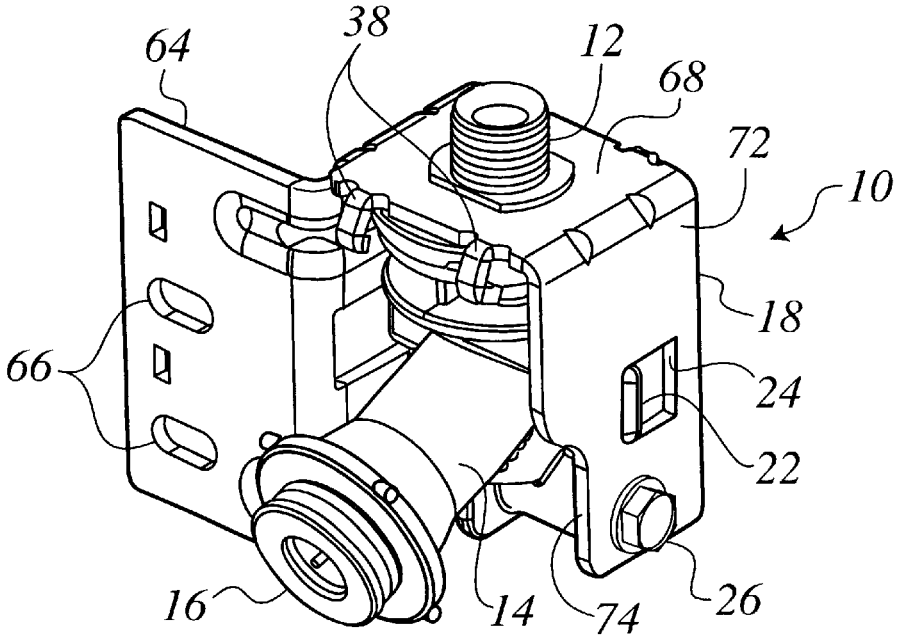
FIG. 3 is a perspective view of a transition fitting in accordance with the present invention.
Figure 4:
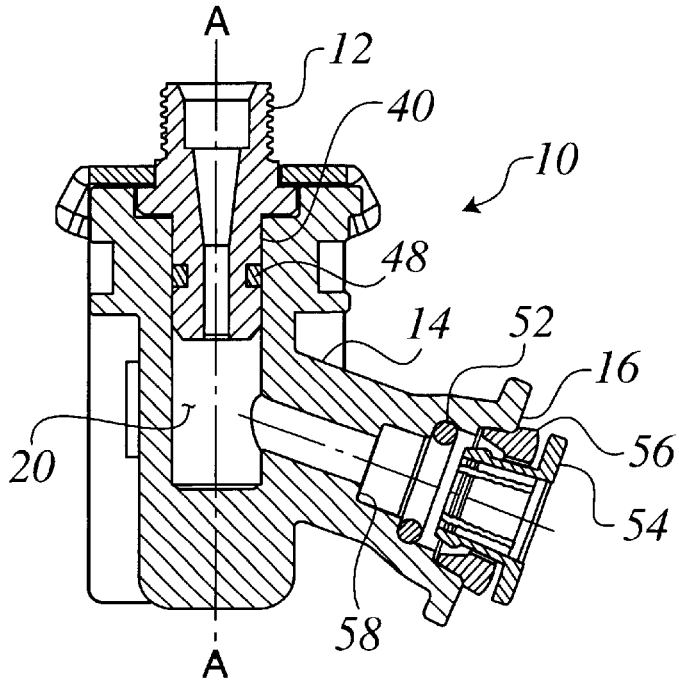
FIG. 4 is a cross-sectional view of the transition fitting of FIG. 3.

A transition fitting according to certain embodiments of the invention is illustrated in FIGS. 3 and 4. The transition fitting 10 includes an inlet 12, a body 14, an outlet 16, and a bracket 18. The inlet 12 receives fluid from an inlet line (not shown), and the fluid is transmitted through a channel 20 in the body 14 to the outlet 16. The fluid exits the outlet 16 into all outlet line (not shown). The bracket 18 at least partially surrounds the body 14, and the bracket 18 can be used to attach the transition fitting 10 to a surface. Although not limited in this manner, the channel 20 is always-open and/or a constant volume. By having an always-open or constant volume, the flow of the fluid through the channel 20 is unimpeded. In contrast, a valve is not always-open and does not have a constant volume channel; and as such, the fluid flow through a valve can be interrupted, such as when the valve malfunctions.

Figure 5:
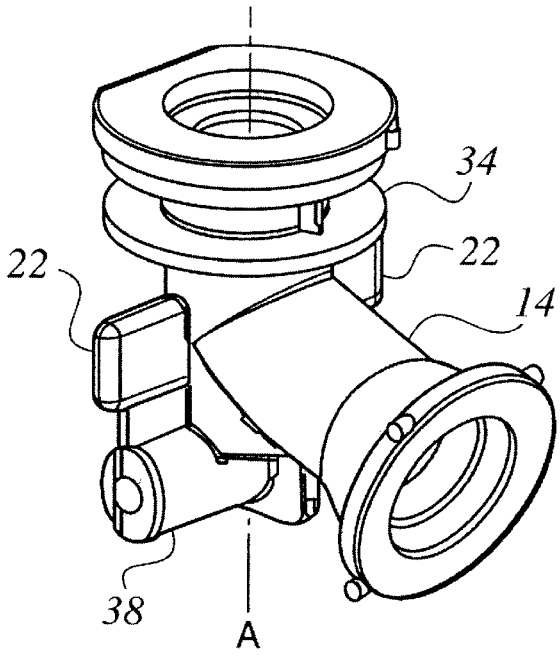
FIG. 5 is a perspective view of a body used with the transition fitting of FIG. 3.
Figure 6:
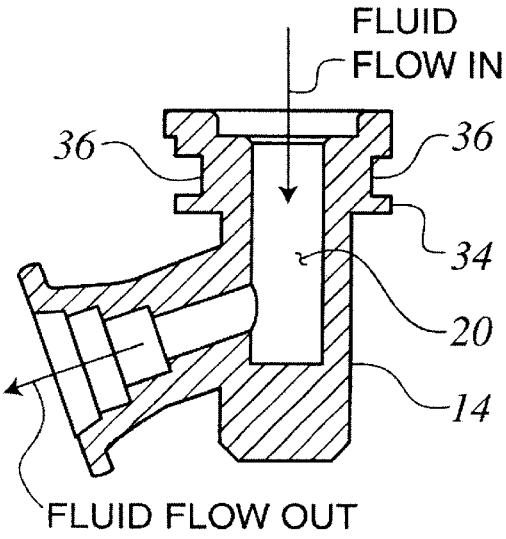
FIG. 6 is a cross-sectional view of the body of FIG. 5.
Figure 7:
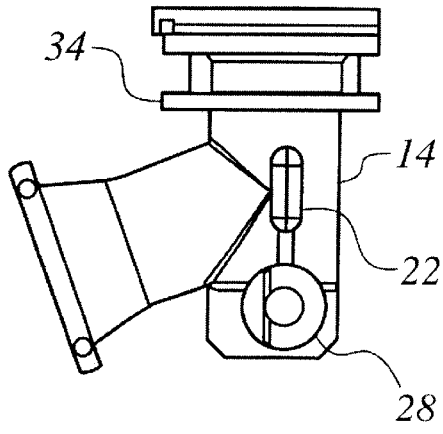
FIG. 7 is a side view of the body of FIG. 5.

A body 14 for use with the transition fitting 10 is illustrated in FIGS. 5–7. Any body 14 capable of directing fluid from an inlet 12 to a outlet 16 is acceptable for use with the transition fitting 10. However, in one aspect, the body 14 redirects a direction of the fluid entering the inlet 12 such that the fluid exits the outlet 16 in a direction different than the direction of the fluid entering the inlet 12.

In certain applications, the inlet line and outlet line are oriented to the transition fitting 10 in different directions. Also, the volume of space within a fluid system, such as a refrigerator, is limited, which hampers any readjustment of the inlet and outlet lines so as to easily connect with the transition fitting 10. However, by providing a body 14 that redirects the direction of fluid entering the inlet 12, the transition fitting can accommodate the inlet and outlet lines being oriented relative to the transition fitting 10 without requiring the readjustment of the inlet and outlet lines.

The pressure of the fluid received by the transition fitting 10 can be high enough to drive the fittings, such as the inlet 12 and outlet 16, from the body 14. The high pressure of the fluid can also cause the body 14 and fittings to rotate relative to the bracket 18. If the body 14 rotates to such an extent that either the inlet and/or outlet line becomes disconnected from the body 14 and/or if the fittings are driven from the body 14, leaking of the fluid can occur. As such, in certain aspects of the invention, the transition fitting 10 includes features to prevent the fittings from being driven from the body 14 and prevent rotation of the body 14 relative to the bracket 18. In this manner, the body 14, the fittings, and the bracket 18 can remain locked together.

As an example of a feature that prevents the fittings from being driven from the body 14 and prevents rotation of the body 14 relative to the bracket 18, the body 14 can include at least one locking tab 22 that interacts with the bracket 18 (best shown in FIG. 3) to prevent rotation of the body 14 relative to the bracket 18. The locking tab 22 can also interact with the bracket 18 to position the body 14 relative to the bracket 18 in a particular orientation. A locking tab 22 capable of orienting and preventing rotation of one object relative to another object is well known by those skilled in the art, and the transition fitting 10 is riot limited as to a particular type of locking tab 22. In certain aspects of the body 14, the body 14 includes two locking tabs 22 that are bilaterally disposed relative to an axis A, about which the body 14 rotates relative to the bracket 18. In so doing, forces exerted by the bracket 18 against the body 14 through the locking tabs 22 cancel out each other.

In one aspect of the body 14, the locking tabs 22 protrude from the body 14. Although not necessary, the locking tab 22 can include at least one surface oriented parallel to the axis A. By orienting the surface parallel to the axis A, as the locking tab 22 interacts with the bracket 18, the orientation of the force exerted by the bracket 18 against the locking tab 22 does not include any component parallel to the axis A, which would tend to move the body 14 up or down on the axis A relative to the bracket 18. The locking tabs 22 can also prevent movement of the body 14 in a direction parallel to the axis A.

As will be discussed further below, the bracket 18 includes locking tab slots 24. By positioning the locking tabs 22 on the body 14 at a specific orientation, the interaction of the locking tabs 22 with the locking tab slots 24 determines the orientation of the body 14 relative to the bracket 18. As such, the locking tabs 22 enable the body 14 to be consistently positioned relative to the bracket 18 at a precise orientation.

Figure 18:
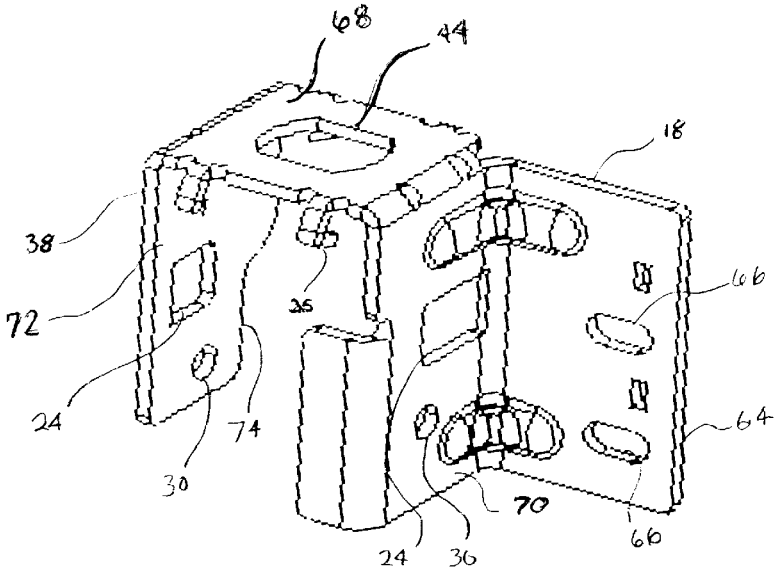
FIG. 18 is a perspective view of a bracket used with the transition fitting of FIG. 3.
Figure 19:
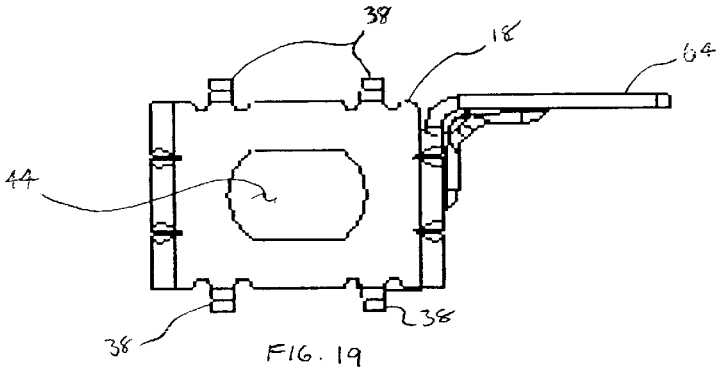
FIG. 19 is a top plan view of the bracket of FIG. 18.
Figure 20:
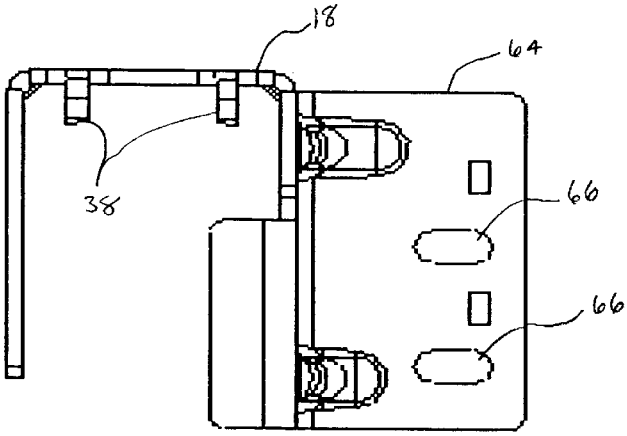
FIG. 20 is a rear view of the bracket of FIG. 18.
Figure 21:
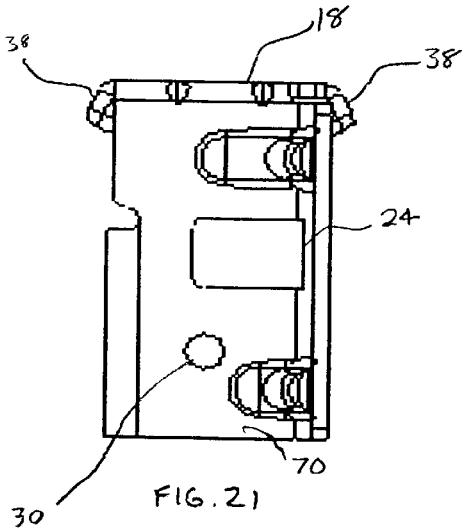
FIG. 21 is a side view of the bracket of FIG. 18.

The body 14 may also include at least one removable fastener 26 (best shown in FIG. 3) for connecting the body 14 to the bracket 18 and for preventing movement of the body 14 relative to the bracket 18. A fastener 26 capable of preventing movement of one object relative to another object is well known by those skilled in the art, and the transition fitting 10 is not limited as to a particular type of fastener 26. In certain aspects of the body 14, the body 14 includes two fasteners 26 that are bilaterally disposed relative to the axis A. In so doing, forces that may be exerted by the bracket 18 against the body 14 through the fasteners 26 can be cancelled out, thereby minimizing possible rotation of the body 14 relative to the bracket 18. In one aspect of the transition fitting 10, each fastener 26 is a screw that is inserted through a screw hole 30 (best shown in FIG. 18) in the bracket 18 and is received by a boss 28 on the body 14.

The body 14 can also include a crimping tab ring 34 that interacts with crimping tabs 38 (best shown in FIG. 3) on the bracket 18 to prevent movement of the body 14 relative to the bracket 18. In one aspect of the body 14, four crimping tab slots 36 are positioned within the crimping tab ring 34 on the body 14, and each of the four crimping tab slots 36 respectively interact with a separate crimping tab 38 positioned on the bracket 18.

Figure 8:
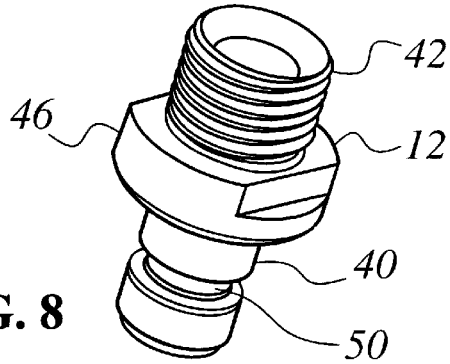
FIG. 8 is a perspective view of an inlet used with the transition fitting of FIG. 3.
Figure 9:
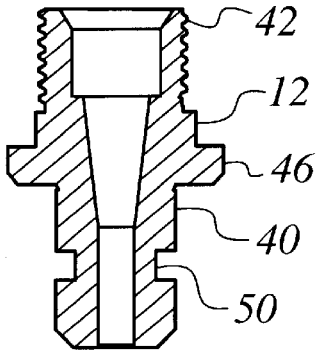
FIG. 9 is a cross-sectional view of the inlet of FIG. 8.
Figure 10:
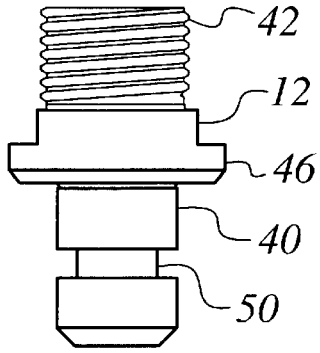
FIG. 10 is a side view of the inlet of FIG. 8.

An inlet 12 for use with the transition fitting 10 is illustrated in FIGS. 8–10. The inlet 12 is connectable to an inlet line, and the inlet 12 receives fluid from the inlet line and directs the fluid in the channel 20 of the body 14. Although shown separable from the body 14, the inlet 12 can be formed integral with the body 14. In certain aspects, the inlet 12 is also rotatable relative to the body 14, and this allows for ease of assembly during which movement of the inlet 12 may be restrained by the bracket 18, but the body 14 can still rotate relative to the bracket 18.

The inlet 12 is not limited as to the type of fittings that are used to connect the inlet 12 to the inlet line. For example, a quick-connect fitting, similar to that described below, can be used. However, in certain aspects of the inlet 12, compression threads 42 are used to attach the inlet line to the inlet 12. Many inlet lines for supplying fluid, such as water, to a fluid system, such as a refrigerator, include threaded fittings. As such, by providing an inlet 12 with compression threads 42, the inlet line can be quickly and easily connected to the inlet 12 without having to replace the fittings on either the inlet 12 or the inlet line.

In one aspect of the inlet 12, the inlet 12 is dimensioned to partially pass through an inlet hole 44 (best shown in FIG. 18) in the bracket 18. In so doing, the fitting on the inlet 12 can be precisely positioned relative to the bracket 18. Also, the portion of the inlet 12 extending through the inlet hole 44 can be bilaterally symmetrical, but without being circular, and the inlet hole 44 can be similarly dimensioned. In so doing, the orientation of the inlet 12 to the bracket 18 is limited to only one of two positions after assembly. In certain aspects, the inlet 12 includes a shoulder 46 having a greater dimension than that of the inlet hole 44 to prevent the inlet 12 from completely passing through the inlet hole 44 and to stop the inlet 12 at a precise position relative to the bracket 18. The shoulder 46 can also include one or more shelves 43 that contact the bracket 18. The shelves 43 can also act to evenly distribute axial loading from the inlet 12 to the bracket 18 and prevent the inlet 12 from being driven from the body 14.

As best shown in FIG. 4, a mating portion 40 of the inlet 12 interacts with the body 14 to fluidly connect the inlet 12 to the body 14, and the inlet 12 is not limited as to a particular mating portion 40 so capable. In one aspect of the inlet 12, the mating portion 40 is dimensioned to be positioned within the channel 20 of the body 14.

Figure 11:
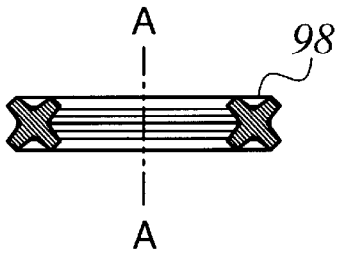
FIG. 11 is a cross-sectional view of a seal used with the transition fitting of FIG. 4.
Figure 12:
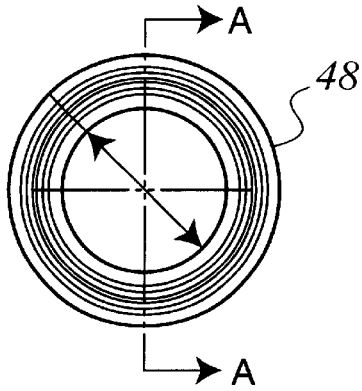
FIG. 12 is a top plan view of the seal of FIG. 11.
Figure 13:
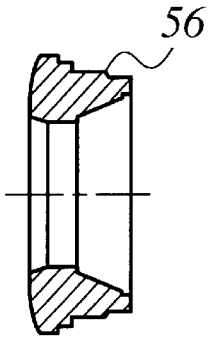
FIG. 13 is a cross-sectional view of a cap used with the transition fitting of FIG. 4.
Figure 14:
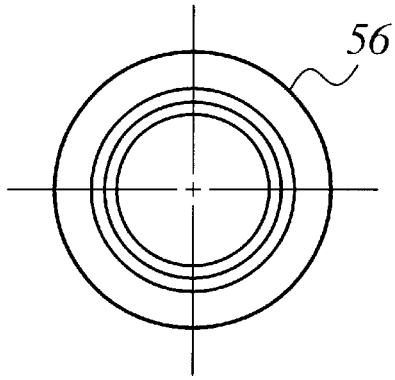
FIG. 14 is a top plan view of the cap of FIG. 13.
Figure 15:
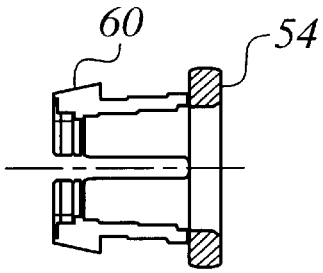
FIG. 15 is a cross-sectional view of a collet used with the transition fitting of FIG. 4.
Figure 16:
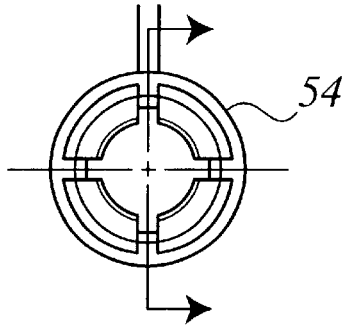
FIG. 16 is a top plan view of the collet of FIG. 15.

A seal 48 can also be provided between the inlet 12 and the body 14 to prevent leakage of fluid at an interface between the inlet 12 and the body 14. Many types of seals 48 are known capable of preventing the leakage of fluid between two objects, and the transition fitting 10 is not limited as to a particular type of seal 48. However, in certain aspects of the transition fitting 10, the seal 48 is a quad-ring seal, as illustrated in FIGS. 11 and 12. Use of a quad-ring seal 48 allows for a greater contact area between the seal 48 and both the inlet 12 and the body 14. Although not limited in this manner, the mating portion 40 of the inlet 12 can include a trench 50 into which the seal 48 can be positioned.

An outlet 16 for use with the transition fitting 10 is illustrated in FIGS. 4 and 13–16. The outlet 16 is connectable to an outlet line, and the outlet 16 directs fluid to the outlet line from the channel 20 of the body 14. Although shown partially separable from the body 14, the outlet 16 can be formed integral with the body 14.

The outlet 16 is not limited as to the type of fittings that are used to connect the outlet 16 to the outlet line. For example, compression threads, similar to those described above, can be used. However, in certain aspects of the outlet 16, a quick-connect fitting is used to attach the outlet line to the outlet 16. Many outlet lines, such as those connected to filtration units, do not include threaded fittings. As such, by providing all outlet 16 with a quick-connect flitting, an outlet line can be quickly and easily connected to the outlet 16 without having to provide fittings for the outlet line.

The outlet 16 is not limited as to a particular type of quick-connect fitting. However, in certain aspects of the outlet 16, the quick-connect fitting includes a seal 52, such as an O-ring, a collet 54 with teeth 60, a cap 56, and a shoulder 58. In operation, the outlet line (not shown) is fitted into the collet 54 in one direction, and the teeth of the collet 54 prevent the outlet line from being pulled out in an opposite direction. The outlet line can also inserted into the channel 20 of the body 14 until a proximal end of the outlet line contacts the shoulder 58, which can be formed integrally with the body 14. The collet 54 is also positioned partially through the cap 56, which prevents the subsequent removal of the outlet line after being inserted into the outlet 16.

Figure 17:
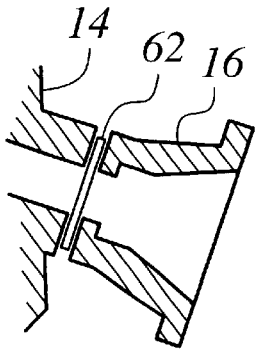
FIG. 17 is a exploded, cross-sectional, partial view of an outlet, washer, and body in accordance with the present invention.

As illustrated in FIG. 17, the outlet 16 can be formed separate from the body 14 and positioned afterwards on the body 14. In this manner, different types of outlets 16 can advantageously be used with a single type of body 14, thereby providing multiple configurations of the body 14 with a reduced amount of tooling. Many types of methods are known capable of connecting the outlet 16 to the body 14, and no one particular method is required for use in practicing the invention. In one embodiment, however, the outlet 16 and the body 14 can be spin-welded together. Spin-welding involves the relative spinning of the outlet 16 to the body 14. While one or both of the outlet 16 and body 14 are spinning, the two are then contacted together. The friction caused by the mating of the outlet 16 and the body 14 causes melting and subsequent solidification that joins the outlet 16 with the body 14.

In one aspect of the transition fitting 10, a flow washer 62 call be inserted between the body 14 and the outlet 16. The flow washer 62 can be used to regulate the flow of the fluid from the channel 20 of the body 14 into the outlet 16. This can be accomplished by changing the size of a hole through the flow washer 62. The flow washer 62 can also be used to reduce noise as the fluid flows through the transition fitting 10.

A bracket 18 for use with the transition fitting 10 is illustrated in FIGS. 18–21. The bracket 18 at least partially surrounds and is connected to the body 14, and the bracket 18 can be used to attach the transition fitting 10 to a surface. Any type of feature can be used to attach the bracket 18 to a surface, and the bracket 18 is not limited in this manner. However, in certain aspects, the bracket 18 includes a mounting flange 64 extending in a direction away from the body 14. The mounting flange 64 can include mounting holes 66 through which a fastener can be used to attach the transition fitting 10 to the surface. The mounting holes 66 can also be configured to match mounting holes formed in a dispenser valve to which the transition fitting 10 can be attached.

The bracket 18 can also include a top portion 68 that is connected to left and right side portions 70, 72. The top portion 68 includes the inlet hole 44, which allows a portion of the inlet 12 to pass through the inlet hole 44, but prevents complete movement of the inlet 12 through the inlet hole 44. In this manner, the inlet 12, and thus the body 14, is restrained in at least one rotational direction relative to the bracket 18.

The top portion 68 can also include flexible crimping tabs 38. During assembly of the transition fitting 10, the crimping tabs 38 can be positioned in one orientation to facilitate the insertion of the body 14 into the bracket 18. After the body 14 has been placed into the bracket 18, the crimping tabs 38 can be manipulated so as to interact with the crimping tab slots 36 in the body 14. In so doing, movement of the body 14 can be restrained in at least one rotational direction relative to the bracket 18.

The left and right side portions 70, 72 can respectively include a locking tab slot 24, which interact with the locking tabs 22 of the body 14. The interaction of the locking tab slots 24 and the locking tabs 22 position the body 14 relative to the bracket 18 in a specific orientation and prevent rotation of the body 14 in at least one rotational direction relative to the bracket 18.

The left and right side portions 70, 72 can also include one screw hole 30 through which a screw 26 or other type of fastener can be inserted and connected to the body 14. In this manner, when the screws 26 are inserted through the screw holes 30 and into the body 14, movement of the body 14 is restrained in at least one rotational direction relative to the bracket 18.

Although not necessary, the bracket 18 can include a recessed portion 74 on either the left or right side portions 70, 72. The recessed portion 74 allows for a greater degree of rotation of the body 14 relative to the bracket 18 during assembly of the transition fitting 10.

Figure 22:
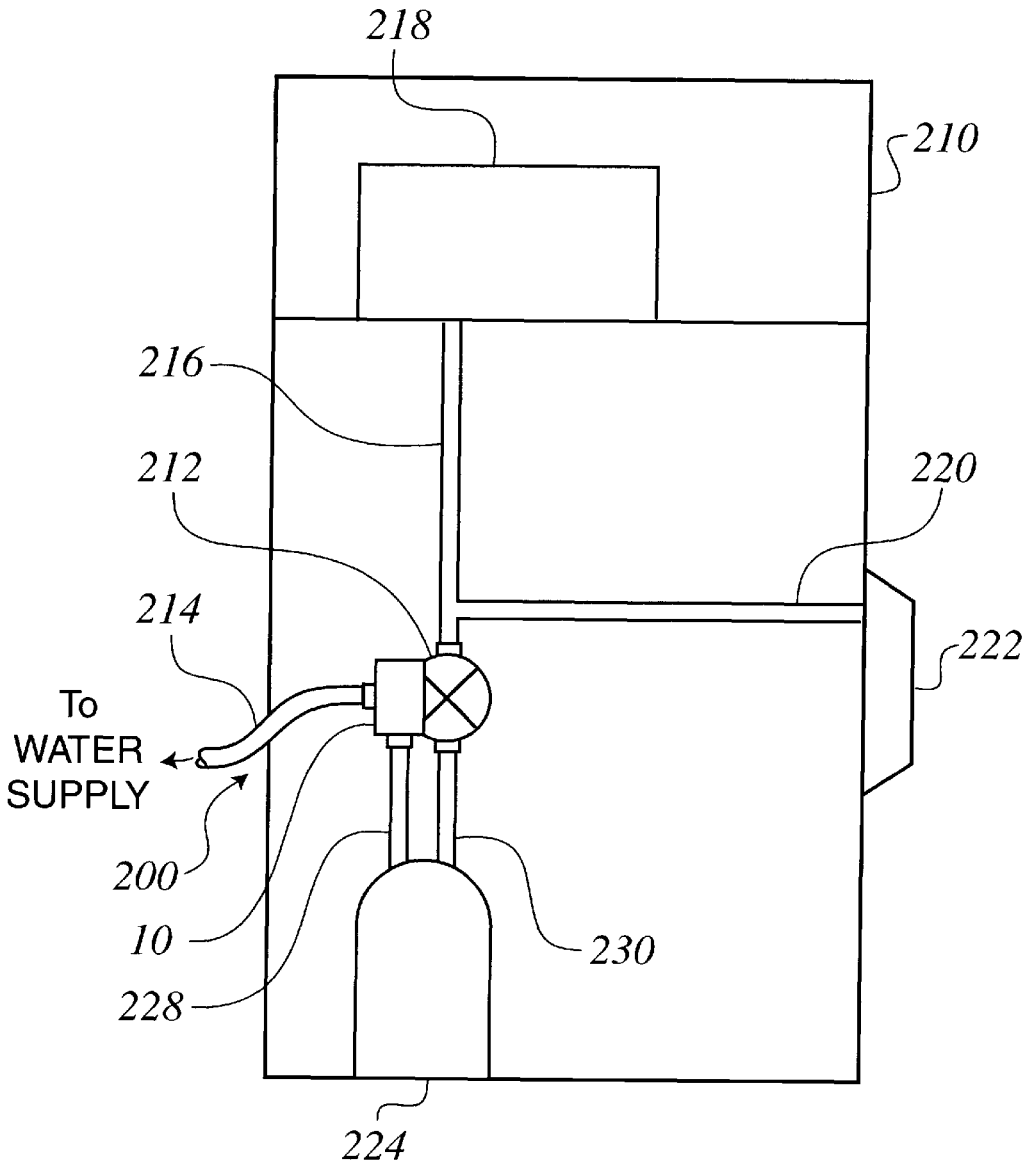
FIG. 22 is a schematic view of a water delivery system in a refrigerator using a transition fitting in accordance with the present invention.

An example of the transition fitting 10 in use with a fluid delivery system 200 in a refrigerator 210 is illustrated in FIG. 22, and although the transition fitting 10 and fluid delivery system 200 are illustrated being used with a refrigerator 210, the transition fitting 10 and fluid delivery system 200 are not limited in this manner. The fluid or water supply system 200 of the refrigerator 210 supplies fluid, such as water, to fluid dispensing devices in the refrigerator 210. Examples of fluid dispensing devices include an automated ice maker 218 and a door water dispenser 222.

The water supply system 200 receives the water from a water supply line 214 that is connected to an external water supply. The supply of the water to the ice maker 218 and the door water dispenser 222 is controlled via a valve 212 that is connected to an outlet line 230 from a filtration system 224. Upon actuation of the valve 212, the valve 212 allows water to flow into supply line 216 for the ice maker 218 and a supply line 220 for the door water dispenser 222.

The transition fitting 10 is used to connect the water supply line 214 to the inlet line 228 for the filtration system 224. If, for example, the water supply line 214 is a pipe with a threaded connector, the transition fitting 10 can also include a threaded connector. Also, if the inlet line 228 does not include any connectors, the transition fitting 10 can also include a quick-connect fitting. In this manner, the transition fitting 10 allows for an easy connection between the water supply line 214 and the inlet line 228.

Additionally, the transition fitting 10 can change the direction of water flow received from the water supply line 214 such that the water flows in a direction towards the filtration system 224. In this manner, bending of the water supply line 214 or the inlet line 228 is not required, thereby simplifying assembly of the water supply system 200 and the refrigerator 210.

As illustrated, the transition fitting 10 can be attached to the valve 212 to reduce the amount of volume within the refrigerator 210 taken up by the transition fitting 10. Also, because the transition fitting 10 is not necessarily a valve, the transition fitting 10 is less expensive, more reliable, and requires less space than a valve.

The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without resorting to the details specifically set forth. In other instances, well known processing structures have not been described in detail, in order not to unnecessarily obscure the present invention.

Only the preferred embodiment of the present invention and but a few examples of its versatility are shown and described in the present disclosure. It is to be understood that the present invention is capable of use in various other combinations and environments and is capable of changes or modifications within the scope of the inventive concept as expressed herein.

What is claimed is:

1. A transition fitting for directing fluid from a first line into a second line, comprising:

a body defining a channel;

an inlet connected to the body and connectable to the first line, the inlet directing the fluid from the first line into the channel;

an outlet connected to the body and connectable to the second line, the outlet directing the fluid from the channel into the second line; and a bracket connected to and at least partially surrounding the body, wherein the channel redirects a direction of the fluid entering the inlet, and a cross-sectional area of the channel is constant.

2. The invention according to claim 1, wherein at least one of the inlet and the outlet includes a threaded compression connector.

3. The invention according to claim 1, wherein at least one of the inlet and outlet includes a quick-connect fitting.

4. The invention according to claim 1, wherein the bracket includes two opposing locking tab slots and the body includes two opposing locking tabs, and when each locking tab is inserted into a locking tab slot, rotation of the body relative to the bracket is prevented in at least one rotational direction and forces exerted against the body are transferred to the bracket.

5. The invention according to claim 1, wherein the bracket includes crimping tabs and the body includes, crimping tab slots, and when each crimping tab is inserted into a crimping tab slot, rotation of the body relative to the bracket is prevented in at least one rotation direction and forces exerted against the body are transferred to the bracket.

6. The invention according to claim 1, wherein the outlet is detachable from the body.

7. The invention according to claim 1, wherein the inlet is detachable from the body and rotatable relative to the body.

8. A transition fitting for directing fluid from a first line into a second line, comprising:

a body defining a channel;

an inlet connected to the body and connectable to the first line, the inlet directing the fluid from the first line into the channel;

an outlet connected to the body and connectable to the second line, the outlet directing the fluid from the channel into the second line; and a bracket connected to and at least partially surrounding the body, wherein the channel redirects a direction of the fluid entering the inlet, and a cross-sectional area of the channel is constant wherein the bracket includes a top portion, a left side portion, a right side portion, and a rear portion, the left side portion and the right side portion are connected to the rear portion and the top portion, the top portion including an inlet hole through which the inlet is partially inserted.

9. The invention according to claim 8, wherein the inlet has a non-circular cross-section, and when the inlet is partially inserted into the inlet hole, the top portion of the bracket prevents rotation of the inlet relative to the bracket in at least one rotational direction and prevents movement of the inlet relative to the body.

10. The invention according to claim 8, further comprising a pair of fasteners, wherein the left side and the right side portions each include a hole through which one of the fasteners is partially inserted, and each of the fasteners respectively connected to the body to prevent rotation of the body relative to the bracket in at least one rotational direction and prevent movement of the body relative to the bracket in a direction along an axis of the body.

11. The invention according to claim 1, further comprising a flow washer disposed between the outlet and the body.

12. A transition fitting for directing fluid from a first line into a second line, comprising:

a body defining a channel within the valve housing, the body including a pair of opposing locking tabs;

an inlet connected to the body and connectable to the first line, the inlet including a threaded compression connector and directing the fluid from the first line into the channel;

an outlet connected to the body and connectable to the second line, the outlet including a quick-connect connector and directing the fluid from the channel into the second line;

a bracket connected to and at least partially surrounding the body, the bracket including a non-circular inlet hole, at least one fastener hole and a pair of opposing locking tab slots; and at least one fastener partially passing through the fastener hole and detachably connected to the body, wherein each locking tab is inserted into a locking tab slot to prevent rotation of the body relative to the bracket in at least one rotational direction and transfer forces exerted against the body to the bracket, and the inlet partially passes through the inlet hole, and the bracket prevents rotation of the inlet relative to the bracket in at least one rotation direction and prevents movement of the inlet relative to the body.

13. A transition fitting for directing fluid from a first line into a second line, comprising:

a body defining a channel and including two opposing locking tabs positioned and configured for connection to a bracket;

an inlet connected to the body and connectable to the first line, the inlet directing the fluid from the first line into the channel; and an outlet connected to the body and connectable to the second line, the outlet directing the fluid from the channel into the second line, wherein the channel redirects a direction of the fluid entering the inlet, and a cross-sectional area of the channel is constant.

14. The invention according to claim 13, wherein at least one of the inlet and the outlet includes a threaded compression connector.

15. The invention according to claim 13, wherein at least one of the inlet and outlet includes a quick-connect fitting.

16. The invention according to claim 13, wherein upon inserting each locking tab into a locking tab slot of the bracket, rotation of the body relative to the bracket is prevented in at least one rotational direction and forces exerted against the body are transferred to the bracket.

17. The invention according to claim 13, wherein the body includes crimping tab slots, and upon inserting each crimping tab into a crimping tab slot of the bracket, rotation of the body relative to the bracket is prevented in at least one rotation direction and forces exerted against the body are transferred to the bracket.

18. The invention according to claim 13, wherein the outlet is detachable from the body.

19. The invention according to claim 13, wherein the inlet is detachable from the body and rotatable relative to the body.

20. A transition fitting for directing fluid from a first line into a second line, comprising:

a body defining a channel and including two opposing locking tabs positioned and configured for connection to a bracket;

an inlet connected to the body and connectable to the first line, the inlet directing the fluid from the first line into the channel; and an outlet connected to the body and connectable to the second line, the outlet directing the fluid from the channel into the second line, wherein the channel redirects a direction of the fluid entering the inlet, and a cross-sectional area of the channel is constant, and wherein the inlet has a non-circular cross-section, and upon partially inserting the inlet into an inlet hole in a top portion of the bracket, the top portion of the bracket prevents rotation of the inlet relative to the bracket in at least one rotational direction and prevents movement of the inlet relative to the body.

21. The invention according to claim 13, further comprising a flow washer disposed between the outlet and the body.

* * * * *